US006779916B2

(12) United States Patent
Watanabe

(10) Patent No.: US 6,779,916 B2
(45) Date of Patent: Aug. 24, 2004

(54) ELECTRONIC TIMEPIECE HAVING RESET LEVER WITH BUSH

(75) Inventor: Mamoru Watanabe, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/463,706

(22) Filed: Jun. 17, 2003

(65) Prior Publication Data

US 2004/0004908 A1 Jan. 8, 2004

(51) Int. Cl.[7] ..... G04B 27/02
(52) U.S. Cl. ..... 368/190; 368/195
(58) Field of Search ..... 368/185–187, 368/190–195, 319–321

(56) References Cited

U.S. PATENT DOCUMENTS 4,744,068 A * 5/1988 Nikles et al. ..... 368/190
5,042,016 A * 8/1991 Suzuki et al. ..... 368/74
5,214,625 A * 5/1993 Suzuki et al. ..... 368/192
6,295,249 B1 * 9/2001 Takahashi et al. ..... 368/35
6,394,645 B1 * 5/2002 Suzuki et al. ..... 368/190
6,499,874 B2 * 12/2002 Graemiger ..... 368/190

* cited by examiner

*Primary Examiner*—Vit W. Miska
(74) *Attorney, Agent, or Firm*—Adams & Wilks

(57) ABSTRACT

To provide an electronic timepiece in which there is not a concern of bending a bearing portion of a train wheel by a reset lever and there is not a concern of impairing the bearing portion when hands are set. An electronic timepiece is provided with a reset lever. A guide portion of a bush is provided with a clearance in a diameter direction and is integrated to a bush integrating hole of the reset lever. A lower shaft portion of a transmission wheel, that is, a third wheel & pinion is rotatably integrated to a center hole of the bush. When set to a time display state, a portion of the bush is brought into contact with a bush positioning portion of a main plate and a transmission pinion, that is, a third pinion is brought in mesh with an indicator gear, that is, a center wheel. When set to a time correcting state, a portion of the reset lever is brought into contact with a reset pin and the transmission pinion, that is, the third pinion is not brought in mesh with the display gear, that is, the center wheel.

4 Claims, 12 Drawing Sheets

ELECTRONIC TIMEPIECE HAVING RESET LEVER WITH BUSH

BACKGROUND OF THE INVENTION

The present invention relates to an electronic timepiece having a reset lever having a bush including a bearing portion for rotatably supporting a transmission wheel.

An explanation will be given as follows of structure and operation of a conventional analog electronic timepiece disclosed in Japanese Utility Model Publication No. 45995/1993. In reference to FIG. 10 and FIG. 11, a movement (machine body including a drive portion) 400 of a conventional analog electronic timepiece includes a main plate 402 constituting a board of the movement 400. A dial 404 (shown in FIG. 11 by imaginary lines) is attached to the movement 400. In the analog electronic timepiece, in both sides of the main plate 402, a side thereof having the dial 404 is referred to as "back side" of the movement 400 and a side thereof opposed to the side having the dial 404 is referred to as "surface side" of the movement 400. A train wheel integrated to "surface side" of the movement 400 is referred to as "surface train wheel" and a train wheel integrated to "back side" of the movement 400 is referred to as "back train wheel". A winding stem 410 is integrated rotatably to a winding stem guide hole of the main plate 402. The movement 400 is provided with a switch spring (not illustrated) for determining a position of the winding stem 410 in a direction of a central axis line 410A. A clutch wheel 408 is arranged coaxially with the winding stem 410. When the winding stem 410 is disposed at 0 stage, that is, in a time display state, the clutch wheel 408 is constituted not to rotate even when the winding stem 410 is rotated. When the winding stem 410 is at 1 stage, the clutch wheel 408 is constituted to rotate by rotating the winding stem 410. On "surface side" of the movement 400, an area on the left side of the central axis line 410A of the winding stem 410 (first area) and an area on the right side of the central axis line 410A of the winding stem 410 (second area) are defined.

On "surface side" of the movement 400, there are arranged a battery 420, a circuit block (not illustrated), a step motor 428, a surface train wheel, a switch apparatus (not illustrated) and so on. The surface train wheel is rotated by rotating the step motor 428. IC (not illustrated) and a crystal oscillator 422 are attached to the circuit block. The battery 420 constitutes a power source of the analog electronic timepiece. The crystal oscillator 422 constitutes an oscillation source of the analog electronic timepiece and is oscillated at, for example, 32,768 Hertz. The surface train wheel is rotatably supported by the main plate 402 and a train wheel bridge 412. On "surface side" of the movement 400, the battery 420 is arranged at the area (first area) on the left side of the central axis line 410A of the winding stem 410 and the crystal oscillator 422 is arranged at the area (first area) on the left side of the central axis line 410A of the winding stem 410.

The step motor 428 includes a coil block 430, a stator 432, and a rotor 434. The coil block 430 magnetizes the stator 432 to rotate the rotor 434 when the coil block 430 is inputted with a motor drive signal outputted by IC. The rotor 434 is constituted to rotate by, for example, 180 degrees per second. On "surface side" of the movement 400, a wire winding portion of the coil block 430 is arranged at the area (second area) on the right side of the central axis line 410A of the winding stem 410 and the rotor 434 is arranged at the area (second area) on the right side of the central axis line 410A of the winding stem 410.

A second wheel & pinion 442 is constituted to rotate via rotation of a fifth wheel & train 440 based on rotation of the rotor 434. The second wheel & pinion 442 includes a second wheel 442*b*, a second pinion 442*c*, a second upper shaft portion 442*f* and an abacus bead portion 442*g*. The second wheel & pinion 442 is constituted to rotate by one rotation per minute. A second hand 444 is attached to the second wheel & pinion 442. The rotational center of the second wheel & pinion 442 is arranged at the center of the main plate 402.

A third wheel & pinion 450 is constituted to rotate based on rotation of the second wheel & train 442. The third wheel & pinion 450 includes a third gear 450*b*, a third pinion 450*c*, a third upper shaft portion 450*f* and a third lower shaft portion 450*g*. A center wheel & pinion 452 is constituted to rotate based on rotation of the third wheel & pinion 450. The center wheel & pinion 452 includes a center wheel 452*b*, a center pinion 452*c* and a center core 452*d*. A minute hand 464 is attached to the center wheel & pinion 452. The center wheel & pinion 452 is constituted to rotate by one rotation per hour. The third upper shaft portion 450*f* of the third wheel & pinion 450 and the second upper shaft portion 442*f* of the second wheel & train 442 are rotatably supported by the train wheel bridge 412. An outer peripheral portion of the center core 452*d* is rotatably supported by the main plate 402. The abacus bead portion 442*g* of the second wheel & pinion 442 is rotatably supported by a center hole of the center core 452.

A minute wheel 474 is constituted to rotate based on rotation of the center wheel & pinion 452. An hour wheel 460 is constituted to rotate based on rotation of the minute wheel 474. A center hole of the hour wheel 460 is rotatably supported by an hour wheel support portion 402*b* of the main plate 402. The hour wheel 460 is constituted to rotate by one rotation per 12 hours. An hour hand 466 is attached to the hour wheel 460.

A clutch plate 480 having a resetting function similar to the reset lever is rotatably arranged to a clutch plate pin 402*c* of the main plate 402. The clutch plate 480 includes a winding stem contact elastic portion 480*a*, a rigid portion 480*b*, a spring portion 480*c* and a reset operation portion 480*f*. A third lower bearing portion 480*d* for rotatably supporting the third lower shaft portion 450*g* of the third wheel & pinion 450, is provided at the rigid portion 480*b*. The main plate 402 is provided with a clutch plate positioning portion 402*f* for determining a position of the clutch plate 480 when the winding stem 410 is disposed at 0 stage. A reset pin 426 is attached to the main plate 402. The reset pinion 426 is constituted to conduct to a reset terminal of IC. It is constituted that when the clutch plate 480 is brought into contact with the reset pin 426, reset operation is carried out. On "surface side" of the movement 400, the clutch plate 480 is arranged at the area (second area) on the right side of the central axis line 410A of the winding stem 410 except a front end portion of the winding stem contact elastic portion 480*a*.

When the winding stem 410 is disposed at 0 stage, a front end of the winding stem 410 pushes the winding stem contact elastic portion 480*a* and the reset operation portion 480*f* is brought into contact with the clutch plate positioning portion 402*f*. Under the state, the third pinion 450*c* is constituted to be brought in mesh with the center wheel 452*b*. On "surface side" of the movement 400, the reset pin 426, and the clutch plate positioning portion 402*f* are arranged at the area (second area) on the right side of the central axis line 410A of the winding stem 410.

In reference to FIG. 12, when the winding stem 410 is pulled to 1 stage, that is, in a time correcting state, the front end of the winding stem 410 leaves the winding stem contact elastic portion 480*a*, the clutch plate 480 is rotated by spring force of the spring portion 480*c* and the reset operation portion 480*f* is brought into contact with the reset pin 426. Under the state, the third pinion 450*c* is not brought in mesh with the center wheel 452*b*. When the winding stem 410 is rotated under the state, the clutch wheel 408 is rotated and the center wheel & pinion 452 and the hour wheel 460 are rotated via rotation of the minute wheel 474 in mesh with the clutch wheel 408. According to the structure, in resetting the hands by pulling the winding stem 410 to 1 stage, in a state of stopping the second hand 444, by rotating the winding stem 410, the minute hand 464 and the hour hand 466 can be rotated. It is constituted that when the reset operation portion 480*f* is brought into contact with the reset pin 426, IC does not output the motor drive signal.

Further, other structures of the conventional analog electronic timepiece having the clutch plate and the third wheel & pinion having the reset function are disclosed in Japanese Utility Model Laid-Open No. 49281/1983, Japanese Patent Laid-Open No. 173991/1988, Japanese Patent Laid-Open No. 227876/1998 and so on.

However, according to the conventional analog electronic timepiece disclosed in Japanese Utility Model Publication No. 45995/1993, a circular hole constituting a third lower bearing portion 402*d* of the third wheel & pinion 450 is formed directly at the clutch plate 480. Therefore, when the hands are reset by pulling the winding stem 410 to 1 stage, the third lower bearing portion 402*d* of the third wheel & pinion 450 is inclined to the circular hole of the clutch plate 480 and therefore, there is a concern of bending or impairing the third lower bearing portion 402*d* by the clutch plate 480. Further, when a difference between a dimension of an inner diameter of the circular hole of the clutch plate 480 and a dimension of an outer diameter of the third lower bearing portion 402*d*, is increased in order to avoid the concern of bending or impairing the third lower bearing portion 402*d* by the clutch plate 480, in an operational state in which the winding stem 410 is set to 0 stage, a position of the third lower bearing portion 402*d* of the third wheel & pinion 450 is not accurately positioned and therefore, there is a concern that a state in which the third pinion 450*c* and the center wheel 452*b* are brought in mesh with each other, becomes unstable.

Further, according to the conventional analog electronic timepiece disclosed in Japanese Utility Model Publication No. 45995/1993, on "surface side" of the movement 400, the battery 420 and the crystal oscillator 422 are arranged at the area (first area) on the left side of the central axis line 410A of the winding stem 410 and the clutch plate 480, the reset pin 426 and the clutch plate positioning portion 402*f* are arranged at the area (second area) on the right side of the central axis line 410A of the winding stem 410 and therefore, it is difficult to reduce the size of the movement.

It is an object of the invention to provide an electronic timepiece, particularly, an analog electronic timepiece in which when a winding stem is pulled to 1 stage and hands are set, there is not a concern of bending a bearing portion of a train wheel by a reset lever and there is not a concern of impairing the bearing portion of the train wheel by the reset lever.

Further, it is other object of the invention to provide an electronic timepiece, particularly, an analog electronic timepiece in which a mesh state of a train wheel is stabilized in an operational state in which a winding stem is disposed at 0 stage.

SUMMARY OF THE INVENTION

The invention is constituted such that in an electronic timepiece including a main plate constituting a board, a train wheel rotated by operating a motor constituting a drive source and a winding stem for correcting time, the train wheel includes a transmission wheel having a transmission gear and a transmission pinion and rotated by operating the motor and an indicator wheel having an indicator gear and an indicator pinion and rotated by rotating the transmission wheel. The electronic timepiece further includes a reset lever constituted to be brought into contact with the winding stem when the electronic timepiece is set to a time display state and not to be brought into contact with the winding stem when the electronic timepiece is set to a time correcting state and provided rotatably to the main plate and having a spring portion and a reset pin constituted to reset the electronic timepiece when the reset lever is brought into contact with the reset pin. According to the electronic timepiece, a guide portion of a bush having a center hole is integrated to a bush integrating hole of the reset lever by providing a clearance in a diameter direction therebetween. Further, according to the electronic timepiece, a lower shaft portion of the transmission wheel is rotatably integrated to the center hole of the bush. For example, the transmission wheel is a third wheel & pinion and the indicator wheel is a center wheel & pinion for integrating a minute hand constituted to indicate "minute".

Further, the electronic timepiece of the invention is characterized to be constituted such that when the electronic timepiece is set to the time display state, a portion of the bush is brought into contact with a bush positioning portion of the main plate, the transmission pinion is brought in mesh with the indictor gear and the indicator wheel is rotated by operating the motor via rotation of the transmission wheel and constituted such that when the electronic timepiece is set to a time correcting state, the reset lever is rotated by a spring force of the spring portion, a portion of the reset lever is brought into contact with the reset pin and the transmission wheel is not brought in mesh with the indictor gear By the constitution, when the hands are set by pulling the winding stem to 1 stage, there can be eliminated a concern of bending a lower bearing portion of the transmission wheel by the reset lever and a concern of impairing the lower bearing portion of the transmission wheel by the reset lever. Further, by the constitution, a state of bringing the transmission wheel and the indictor wheel in mesh with each other can be stabilized in an operational state in which the winding stem is set to 0 stage.

According to the electronic timepiece of the invention, it is preferable that the bush further includes a flange portion and a front end shaft portion, the fixed frame is fitted to the front end shaft portion and an axial direction clearance is provided between the lower face of the reset lever and the upper face of the fixed frame.

Further, it is preferable that a guide portion diameter difference (DH−DB) which is a difference between an inner diameter dimension (DH) of the bush integrating hole of the reset lever and an outer diameter dimension (DB) of the guide portion of the bush, is constituted to be larger than a bearing portion diameter difference (DC−DJ) which is a difference between an inner diameter dimension (DC) of the center hole of the bush and an outer diameter dimension (DJ) of the lower shaft portion of the transmission wheel.

Further, according to the electronic timepiece, it is preferable to constitute such that when a dimension (TB) between a lower face of the flange portion of the bush and an upper face of the fixed frame is equal to or smaller than the inner diameter dimension (DH) of the bush integrating hole of the reset lever, the axial line direction clearance (TS) is larger than the guide portion diameter difference (DH–DB).

By the constitution, when the winding stem is pulled to 1 stage and hands are set, it can be ensured to incline the bush and therefore, there can firmly be eliminated the concern of bending the lower bearing portion of the transmission wheel by the reset lever and there can firmly be eliminated the concern of impairing the lower bearing portion of the transmission wheel by the reset lever.

BRIEF DESCRIPTION OF THE DRAWINGS

A preferred embodiment of the invention will now be described with reference to the accompanying drawings wherein.

DETAILED DESCRIPTION OF THE PREFERRED

Figure 1:
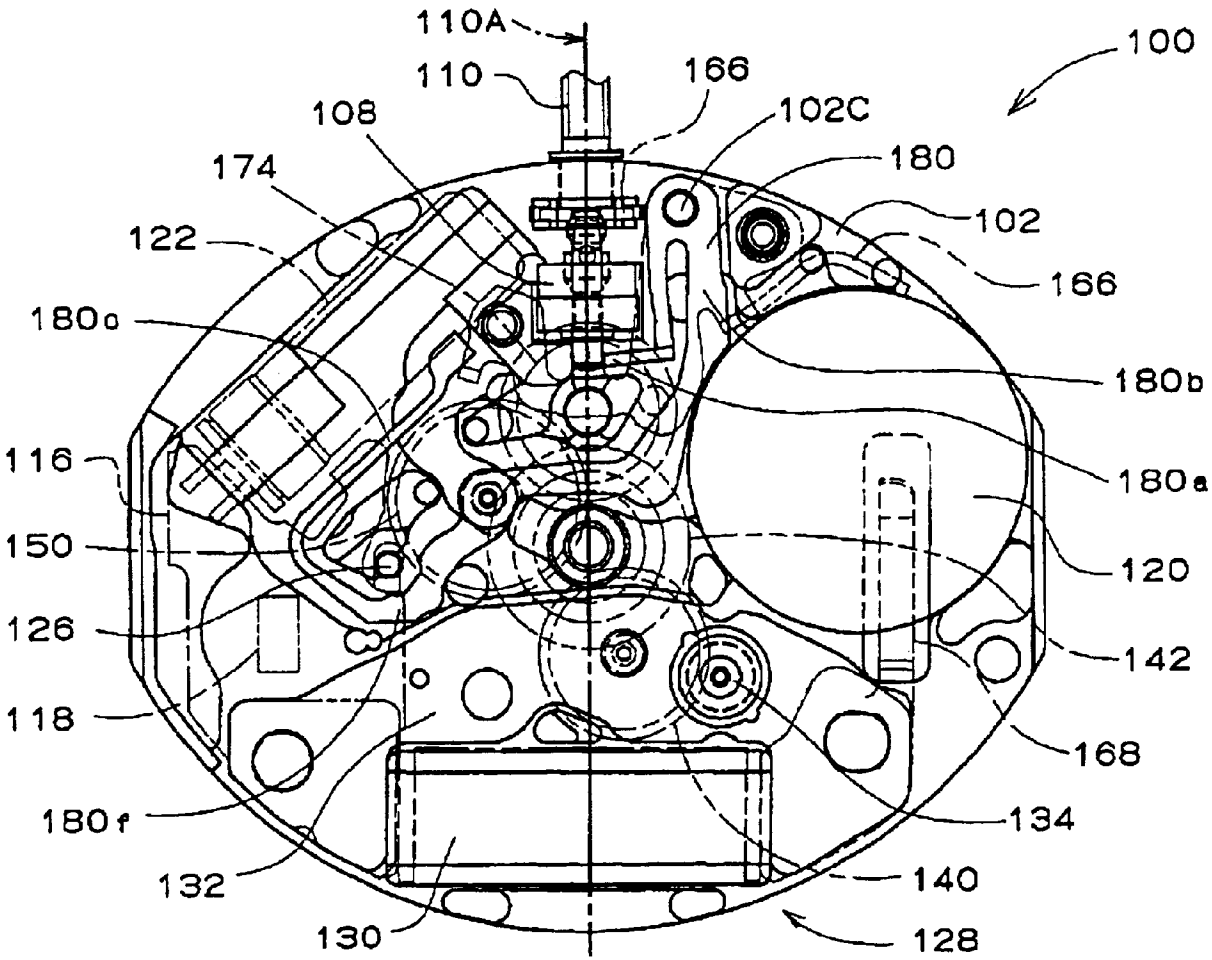
FIG. 1 is a plane view showing an outline shape of a movement viewed from a surface side when a winding stem is disposed at 0 stage according to an embodiment of a timepiece of the invention (In FIG. 1, illustration of a portion of parts is omitted)
Figure 2:
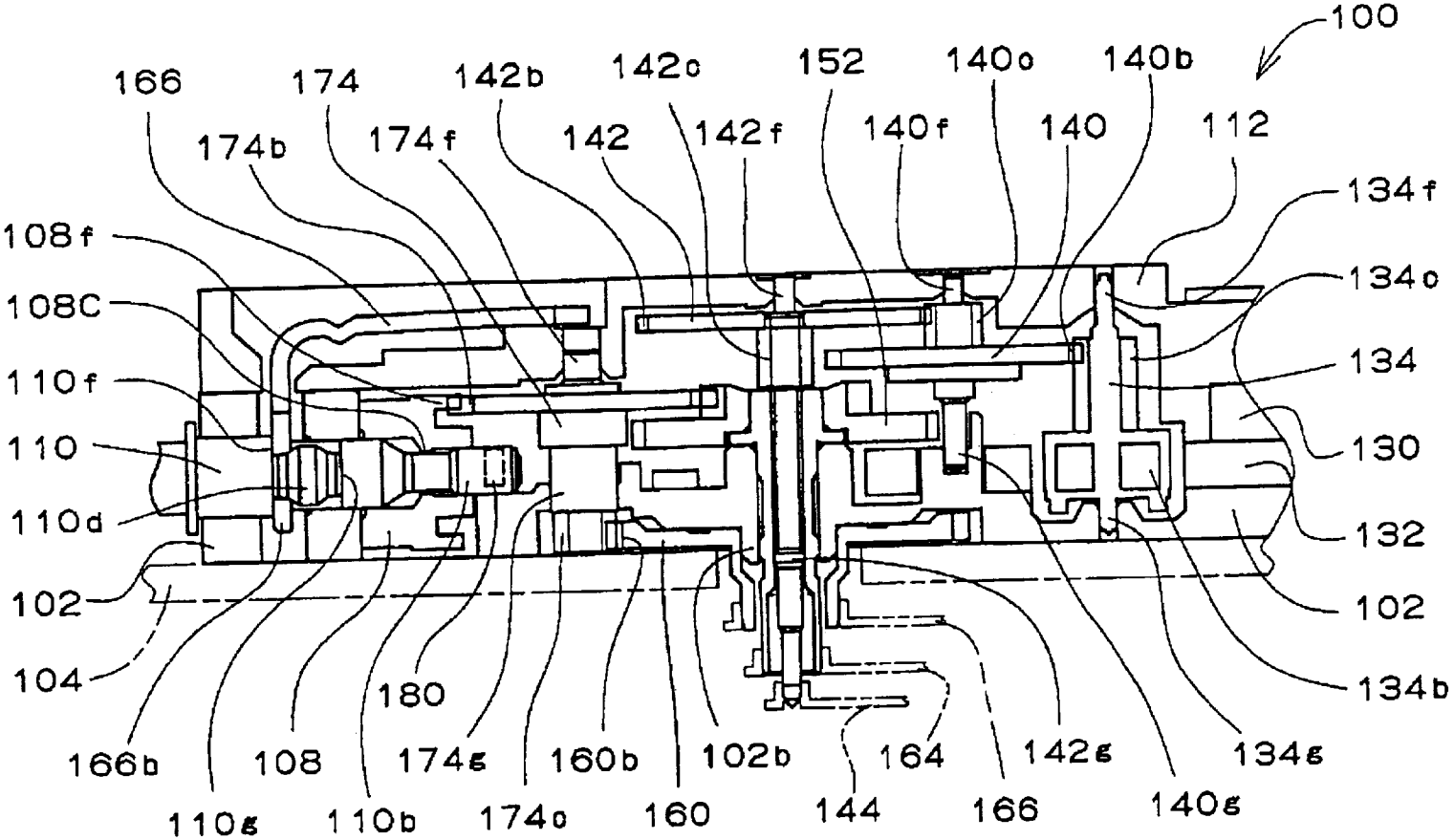
FIG. 2 is an outline partially sectional view showing a winding stem, a minute wheel, a portion of a surface train wheel and a rotor when the winding stem is disposed at 0 stage according to the embodiment of the timepiece of the invention.
Figure 3:
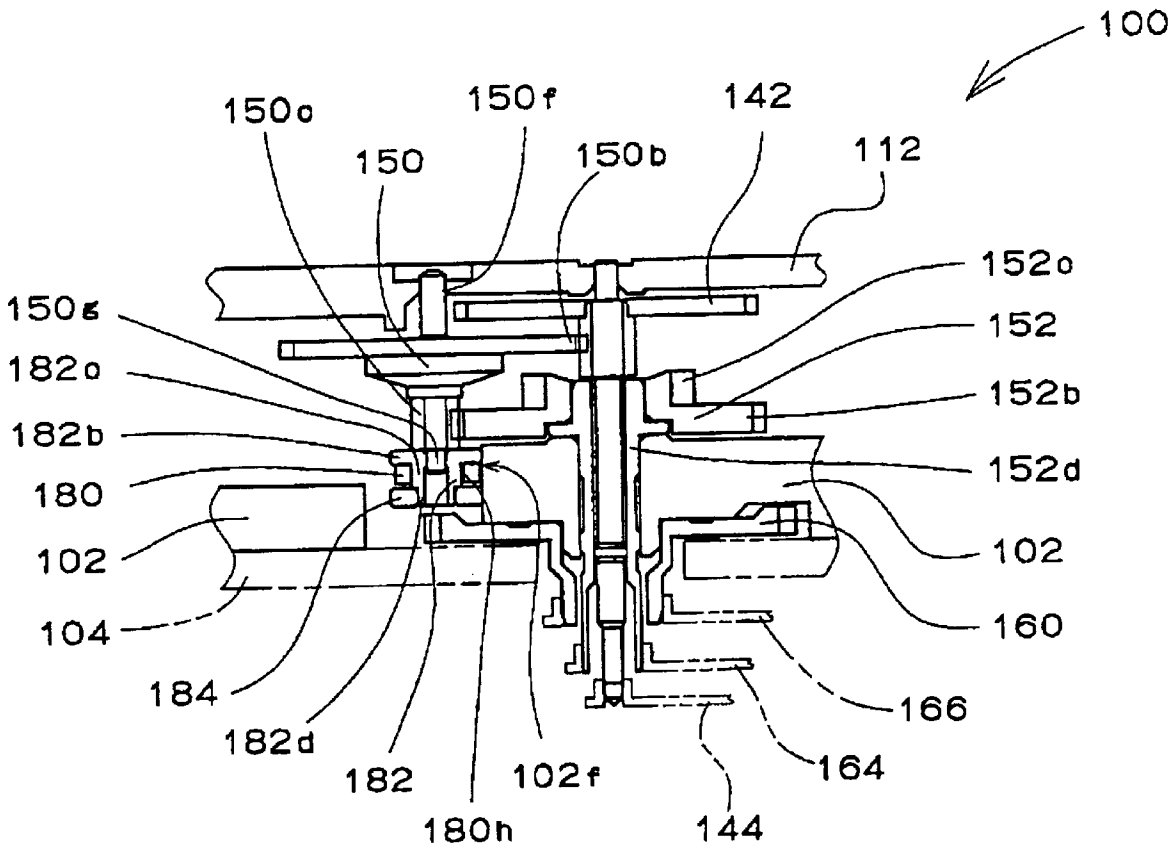
FIG. 3 is an outline partially sectional view showing a center wheel & pinion and a third wheel & pinion when the winding stem is disposed at 0 stage according to the embodiment of the timepiece of the invention.
Figure 4:
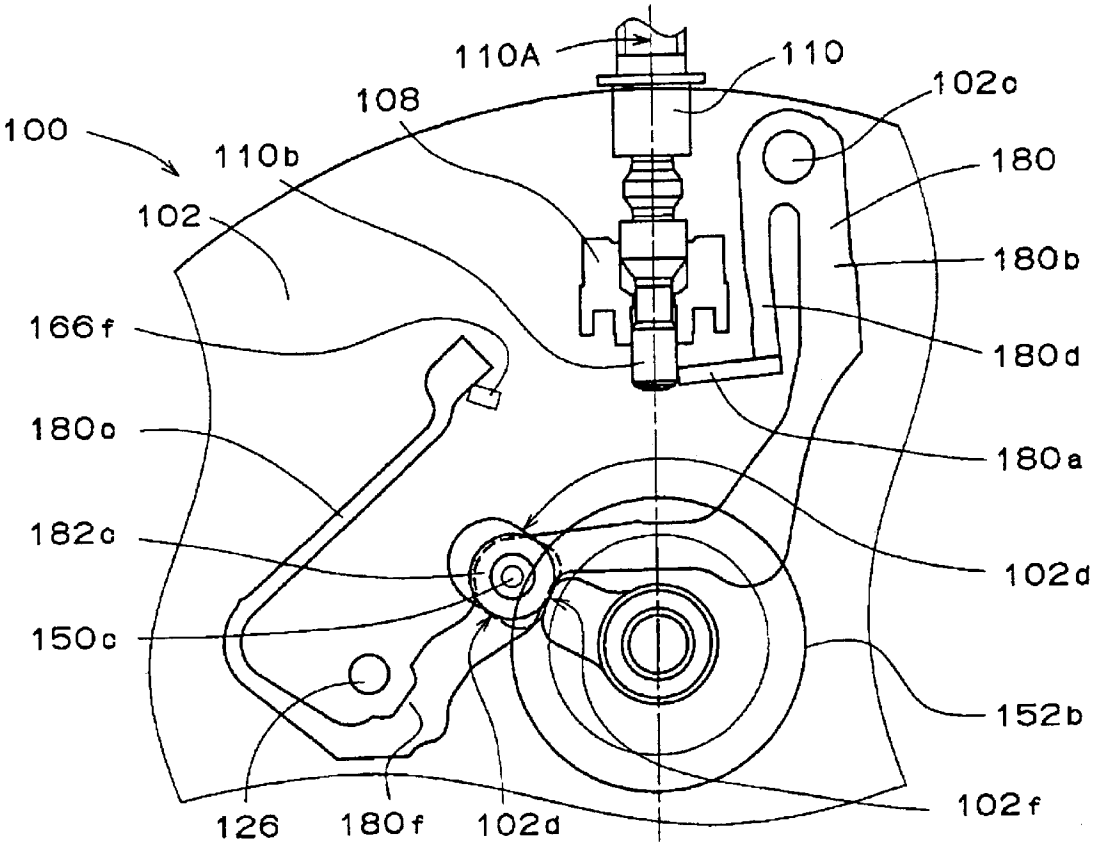
FIG. 4 is a plane view showing outline shapes of the winding stem, a reset lever, a third pinion and a center wheel when the winding stem is disposed at 0 stage according to the embodiment of the timepiece of the invention (In FIG. 4, illustration of other parts are omitted)

An explanation will be given as follows of embodiments of an analog electronic timepiece of the invention in reference to the drawings. In the following description, an explanation will be given of an analog electronic timepiece having a constitution in which the analog electronic timepiece displays time in a state in which a winding stem is disposed at 0 stage and time is corrected by stopping operation of the analog electronic timepiece in a state in which the winding stem is disposed at 1 stage.

(1) A State in Which a Winding Stem is Disposed at 0 Stage (Time Display State)

In reference to FIG. 1 through FIG. 5, according to the embodiment of the analog electronic timepiece of the invention, a movement 100 of the analog electronic timepiece includes a main plate 102 constituting a board of the movement. A dial 104 (shown in FIG. 2 and FIG. 3 by imaginary lines) is attached to the movement 100. A winding stem 110 is rotatably integrated to a winding stem guide hole of the main plate 102. The movement 100 is provided with a battery plus terminal 166 conducted to plus of a battery and determining a position of the winding stem 110 in a direction of a central axis line 110A. That is, a position of the winding stem 110 at 0 stage is determined by positioning a winding stem position determining portion 166*b* provided at the battery plus terminal 166 between a winding stem position determining strip portion 110*d* of the winding stem 110 and an outer side wall portion 110*f* of the winding stem 110.

According to the analog electronic timepiece, in both sides of the main plate 102, a side thereof having the dial 104 is referred to as "back side" of the movement 100 and a side thereof opposed to the side having the dial 104 is referred to as "surface side" of the movement 100. A train wheel integrated to "surface side" of the movement 100 is referred to as "surface train wheel" and a train wheel integrated to "back side" of the movement 100 is referred to as "back train wheel". A clutch wheel 108 is arranged coaxially with the winding stem 110. The winding stem 110 is made of a metal of carbon steel, stainless steel or the like. The clutch wheel 108 is made of a plastic of polyacetal or the like.

A front end shaft portion 10*b* of the winding stem 110 is constituted not to be fitted to an operating small diameter portion 108*c* of the clutch wheel 108 when the winding stem 110 is disposed at 0 stage (when the analog electronic timepiece is set to the time display state). Therefore, the clutch wheel 108 is constituted not to rotate even when the winding stem 110 is rotated in a state in which the winding stem 110 is disposed at 0 stage.

On "surface side" of the movement 100, an area on the left side of the central axis line 110A of the winding stem 110 (first area) and an area on the right side of the central axis line 110A of the winding stem 110 (second area) are defined.

On "surface side" of the movement 100, the battery 120, a circuit block 116, a step motor 128, a surface train wheel and the like are arranged. The surface train wheel is rotated by rotating the step motor 128. IC 118 and a crystal oscillator 122 are attached to the circuit block 116. The battery 120 constitutes a power source of the analog electronic timepiece. The crystal oscillator 122 constitutes an oscillation source of the analog electronic timepiece and is oscillated by, for example, 32,768 Hertz. The surface train is rotatably supported by the main plate 102 and a train wheel bridge 112. On "surface side" of the movement 100, the battery 120 is arranged at the area (second area) on the right side of the central axis line 110A of the winding stem 110 and the crystal oscillator 122 is arranged at the area (first area) on the left side of the central axis line 110A of the winding stem 110.

IC 118 includes an oscillating portion, a dividing portion and a driving portion. The oscillating portion outputs a reference signal based on oscillation of the crystal oscillator 122. The dividing portion of IC 118 divides an output signal of the oscillating portion. The driving portion of IC 118 outputs a motor drive signal for driving the step motor 128 based on an output signal of the dividing portion.

A battery minus terminal 168 is held by the train wheel bridge 112. The battery minus terminal 168 conducts a cathode of the battery 120 and a minus input portion Vss of IC 118 via a minus pattern of the circuit block 116. The battery plus terminal 166 conducts an anode of the battery 120 and a plus input portion Vdd of IC 118 via a plus pattern of the circuit block 116.

The step motor 128 includes a coil block 130, a stator 132 and a rotor 134. The coil block 130 magnetizes the stator 132 to thereby rotate the rotor 134 when the coil block 130 inputs the motor drive signal outputted by IC 118. The rotor 134 includes a rotor magnet 134*b*, a rotor pinion 134*c*, a rotor upper shaft portion 134*f* and a rotor lower shaft portion 134*g*. The rotor 134 is constituted to rotate by, for example, 180 degrees per second. On "surface side" of the movement 100, a wire winding portion of the coil block 130 is arranged to overlap the central axis line 110A of the winding stem 110. Preferably, a half of the wire winding portion of the coil block 130 is arranged at the area (first area) on the left side of the central axis line 110A of the winding stem 110 and other half of the wire winding portion of the coil block 130 is arranged at the area (second area) on the right side of the central axis line 110A of the winding stem 110. On "surface side" of the movement 100, the rotor 134 is arranged at the area (second area) on the right side of the central axis line 110A of the winding stem 110.

A second wheel & pinion 142 is constituted to rotate based on rotation of the rotor 134 via a fifth wheel & pinion 140. The fifth wheel & pinion 140 includes a fifth wheel 140*b*, a fifth pinion 140*c*, a fifth upper shaft portion 140*f* and a fifth lower shaft portion 140*g*. The fifth wheel 140*b* is constituted to be brought in mesh with the rotor pinion 134*c*. The second wheel & pinion 142 includes a second wheel 142*b*, a second pinion 142*c*, a second upper shaft portion 142*f* and an abacus bead portion 142*g*. The second wheel 142*b* is constituted to be brought in mesh with the fifth pinion 140*c*. The second wheel & pinion 142 is constituted to rotate by one rotation per minute. A second hand 144 is attached to the second wheel & pinion 142. A rotational center of the second wheel & pinion 142 is arranged at a center of the main plate 102. The rotational center of the second wheel & pinion 142 may be arranged at the center of the main plate 102 or may be arranged at a position different from the center of the main plate 102.

When desired, there can be provided a train wheel setting lever (not illustrated) operated to rotate when the winding stem 110 is pulled to 1 stage for setting a position of the second wheel & pinion 142 or the fifth wheel & pinion 140.

A third wheel & pinion 150 is constituted to rotate based on rotation of the second wheel & pinion 142. The third wheel & pinion 150 includes a third wheel 150*b*, a third pinion 150*c*, a third upper shaft portion 150*f* and a third lower shaft portion 150*g*. The third wheel 150*b* is constituted to be brought in mesh with the second pinion 142*c*. A center wheel & pinion 152 is constituted to rotate based on rotation of the third wheel & pinion 150. The center wheel & pinion 152 includes a center wheel 152*b*, a center pinion 152*c* and a center core 152*d*. The center wheel 152*b* is constituted to be brought in mesh with the third pinion 150*c*. A minute hand 164 is attached to the center wheel & pinion 152. The center wheel & pinion 152 is constituted to rotate by one rotation per hour.

A minute wheel 174 is constituted to rotate based on rotation of the center wheel & pinion 152. The minute wheel 174 includes a minute gear wheel 174*b*, a minute pinion 174*c*, a minute upper shaft portion 174*f* and a minute lower barrel portion 174*g*. The minute gear wheel 174*b* is constituted to be brought in mesh with the center pinion 152*c*. An hour wheel 160 is constituted to rotate based on rotation of the minute wheel 174. A gear portion 160*b* of the hour wheel 160 is constituted to be brought in mesh with the minute pinion 174*c*. A center hole of the hour wheel 160 is rotatably supported by an hour wheel support portion 102*b* of the main plate 102. The hour wheel 160 is constituted to rotate by one rotation per 12 hours. An hour hand 166 is attached to the hour wheel 160.

A gear portion 108*f* of the clutch wheel 108 is constituted to be brought in mesh with the minute gear wheel 174*b* both when the winding stem 110 is disposed at 0 stage and when the winding stem 110 is pulled to 1 stage.

The rotor upper shaft portion 134*f* of the rotor 134, the fifth upper portion 140*f* of the fifth wheel & pinion 140, the third upper shaft portion 150*f* of the third wheel & pinion 150, the second upper shaft portion 142*f* of the second wheel & pinion 142 and the minute upper shaft portion 174*f* of the minute wheel 174, are rotatably supported by the train wheel bridge 112. The rotor lower shaft portion 134*g* of the rotor 134, the fifth lower shaft portion 140*g* of the fifth wheel & pinion 140 and the minute lower barrel portion 174*g* of the minute wheel 174 are rotatably supported by the main plate 102. The outer peripheral portion of the center core 152*d* is rotatably supported by the main plate 102. The abacus bead portion 142*g* of the second wheel & pinion 142 is rotatably supported by the center hole of the center core 152*d*.

In reference to FIG. 1 and FIG. 3 through FIG. 5, a reset lever 180 having a resetting function is rotatably arranged to a reset lever pin 102*c* of the main plate 102. The reset lever 180 includes a winding stem contact rigid portion 180*a*, a third bush support rigid portion 180*b*, a spring portion 180*c*, an elastic portion 180*d* and a reset operation portion 180*f*. When the winding stem 110 is disposed at 0 stage, the winding stem contact rigid portion 180*a* of the reset lever 180 is constituted to be brought into contact with a side face of the winding stem 110 by spring force of the elastic portion 180*d*. The winding stem contact elastic portion of the reset lever is not constituted to be brought into contact with the side face of the winding stem as in the conventional structure, but, according to the invention, by constituting the winding stem contact rigid portion 180*a* of the reset lever 180 to be brought into contact with the side face of the winding stem 110, the operation of rotating the reset lever 180 can be stabilized and the reset lever 180 can firmly be positioned. A third bush 182 for rotatably supporting the third lower shaft portion 150*g* of the third wheel & pinion 150 is arranged at the third bush support rigid portion 180*b*. The third bush 182 includes a flange portion 182*b*, a guide portion 182*c* and a front end shaft portion 182*d*. The guide portion 182*c* is integrated to a bush integrating hole 180*h* arranged at the third bush support rigid portion 180*b* of the reset lever 180. The guide portion 182*c* is integrated to the bush integrating hole 180*h* to provide a clearance in the diameter direction therebetween. After integrating the guide portion 182*c* to the bush integrating hole 180*h* of the reset lever 180, a center hole 184*c* of the third bush 182 is fitted to a front end shaft portion 182*d* of a fixed frame 184.

Figure 5:
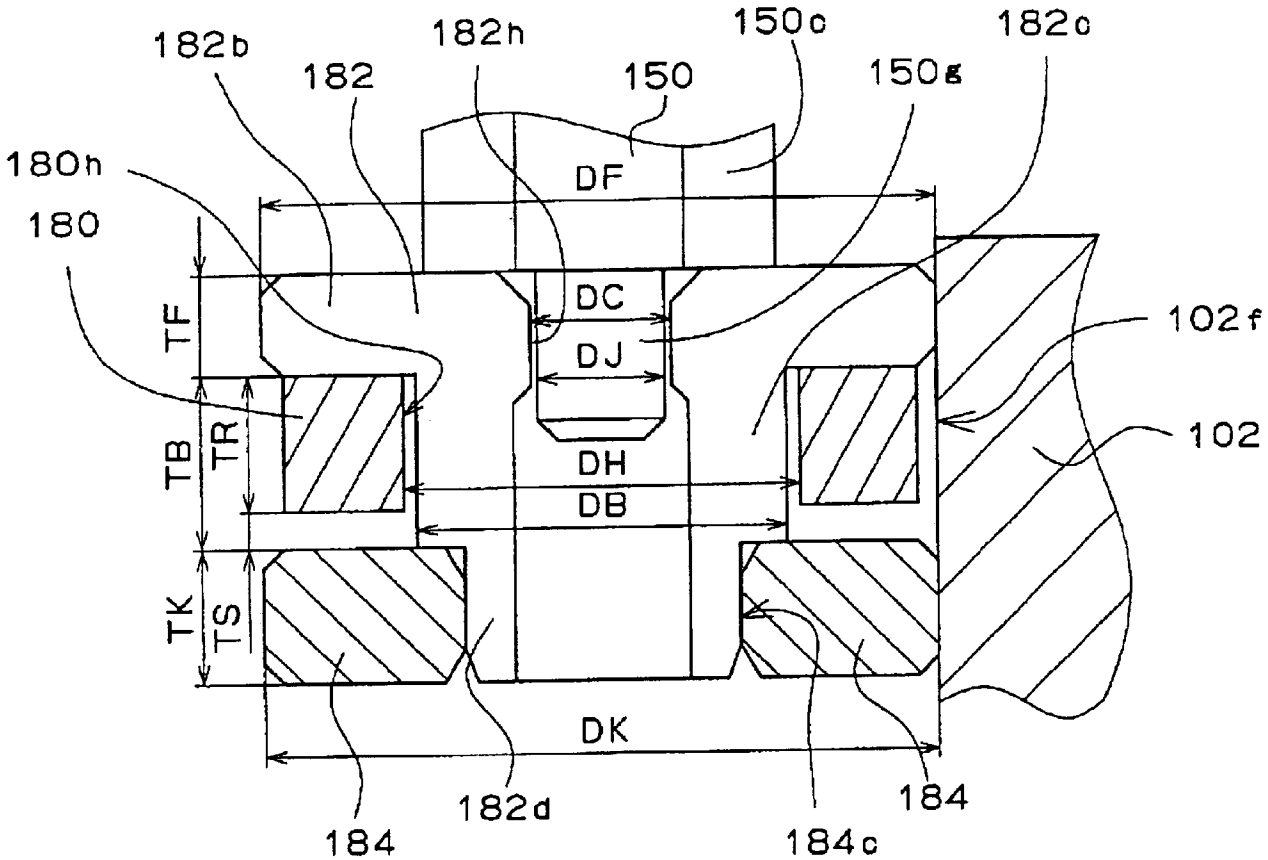
FIG. 5 is an outline of partially sectional view showing outline shapes of a third lower shaft portion, a third bush and a fixed frame when the winding stem is disposed at 0 stage according to the embodiment of the timepiece of the invention.
Figure 6:
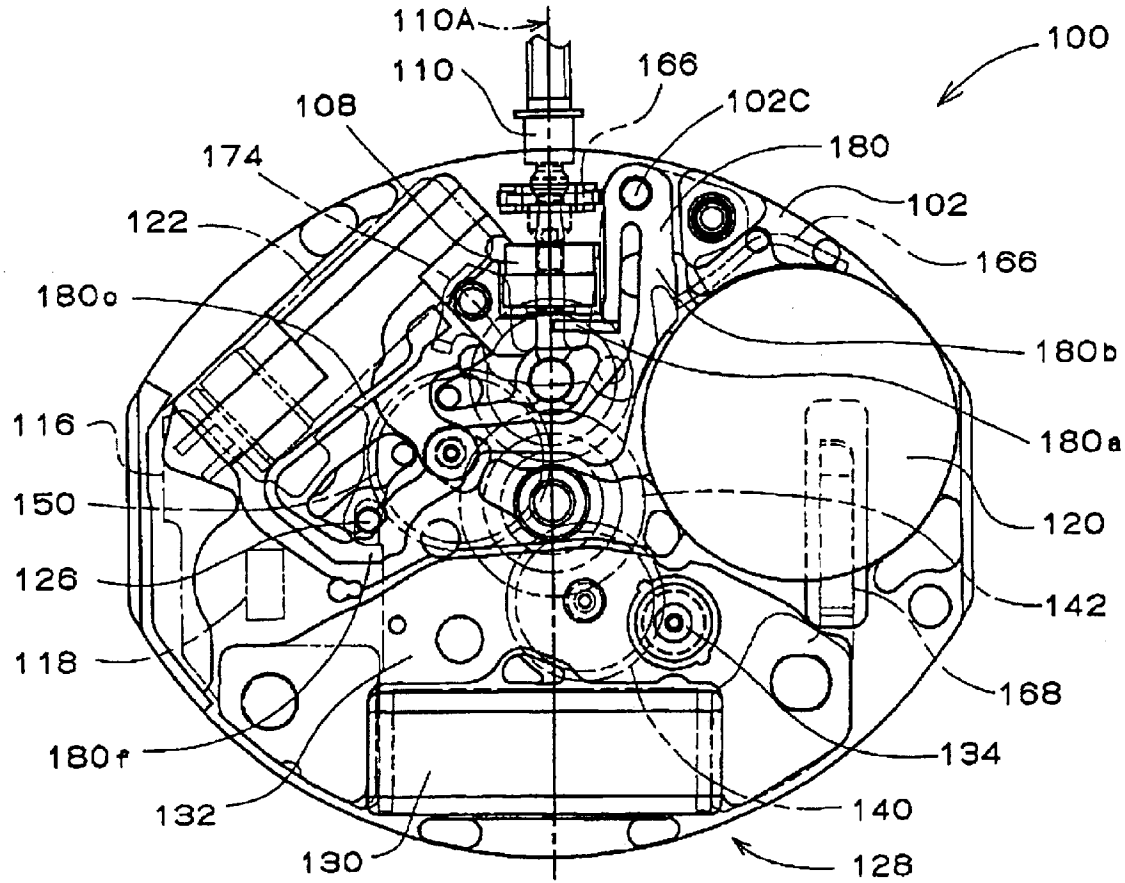
FIG. 6 is a plane view showing the outline shape of the movement viewed from the surface side when the winding stem is disposed at 1 stage according to the embodiment of the timepiece of the invention (In FIG. 6, illustration of a portion of parts is omitted)
Figure 7:
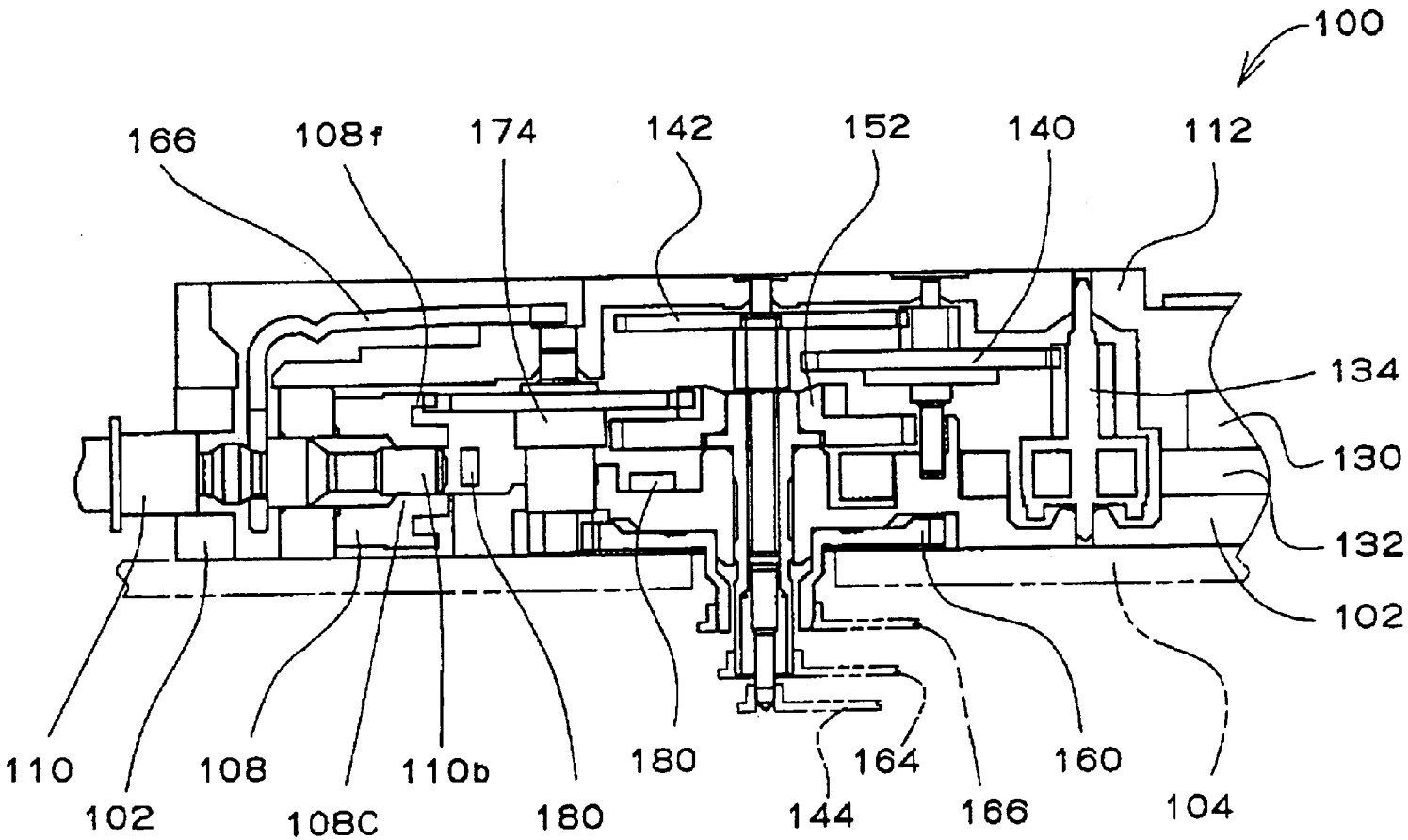
FIG. 7 is an outline of partially sectional view showing the winding stem, the minute wheel, a portion of the surface train wheel and the rotor when the winding stem is disposed at 1 stage according to the embodiment of the timepiece of the invention.
Figure 8:
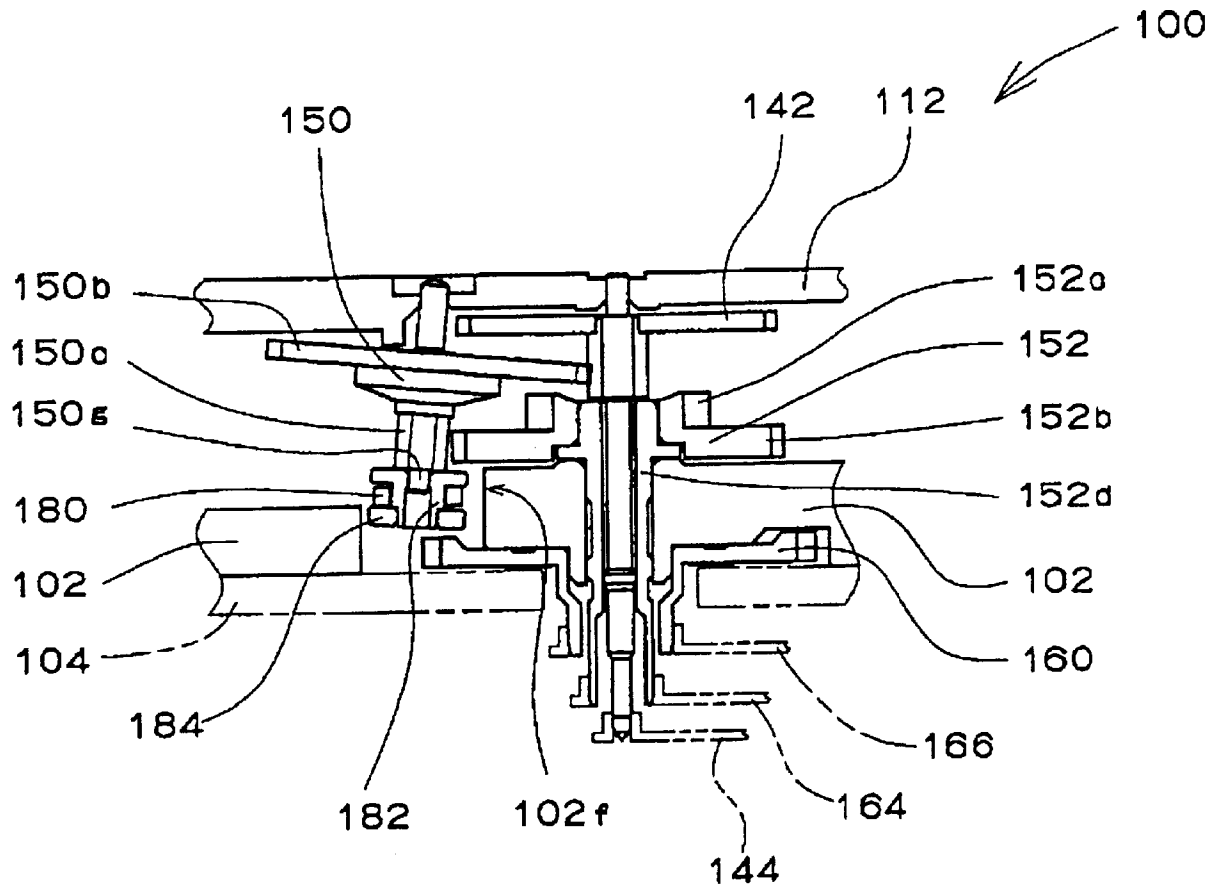
FIG. 8 is an outline of partially sectional view showing the center wheel & pinion and the third wheel & pinion when the winding stem is disposed at 1 stage according to the embodiment of the timepiece of the invention.
Figure 9:
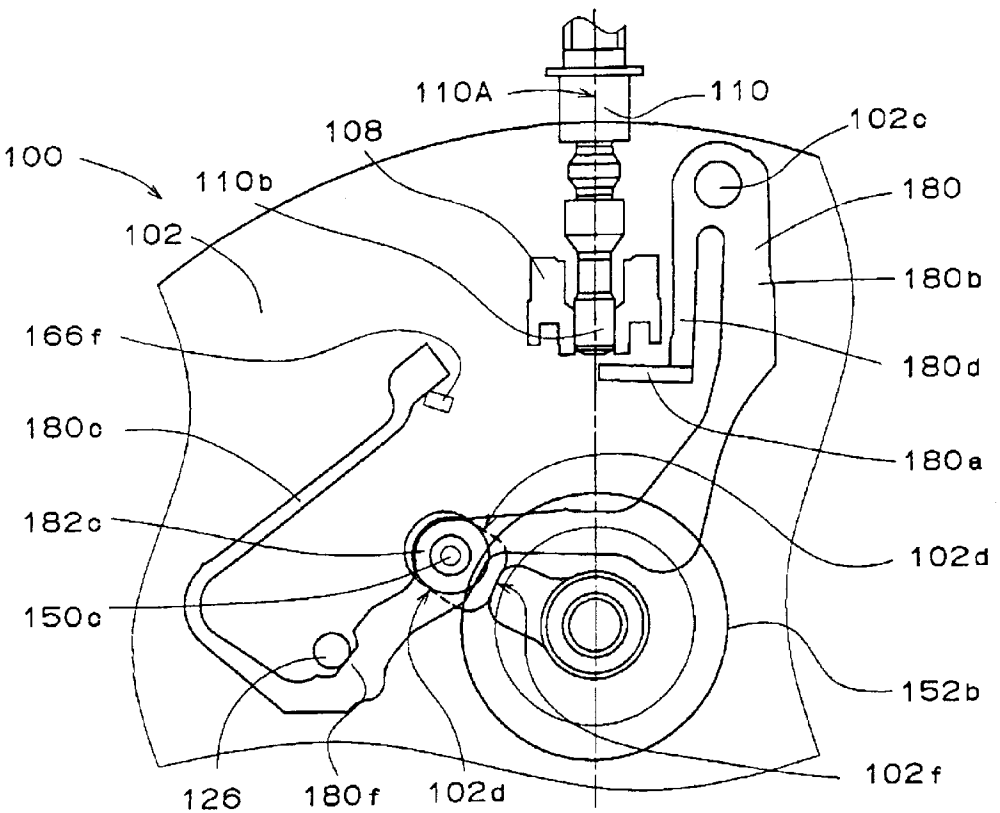
FIG. 9 is a plane view showing the outline shapes of the winding stem, the reset lever, the third pinion and the center wheel when the winding stem is disposed at 1 stage according to the embodiment of the timepiece of the invention (In FIG. 9, illustration of other parts is omitted)
Figure 10:
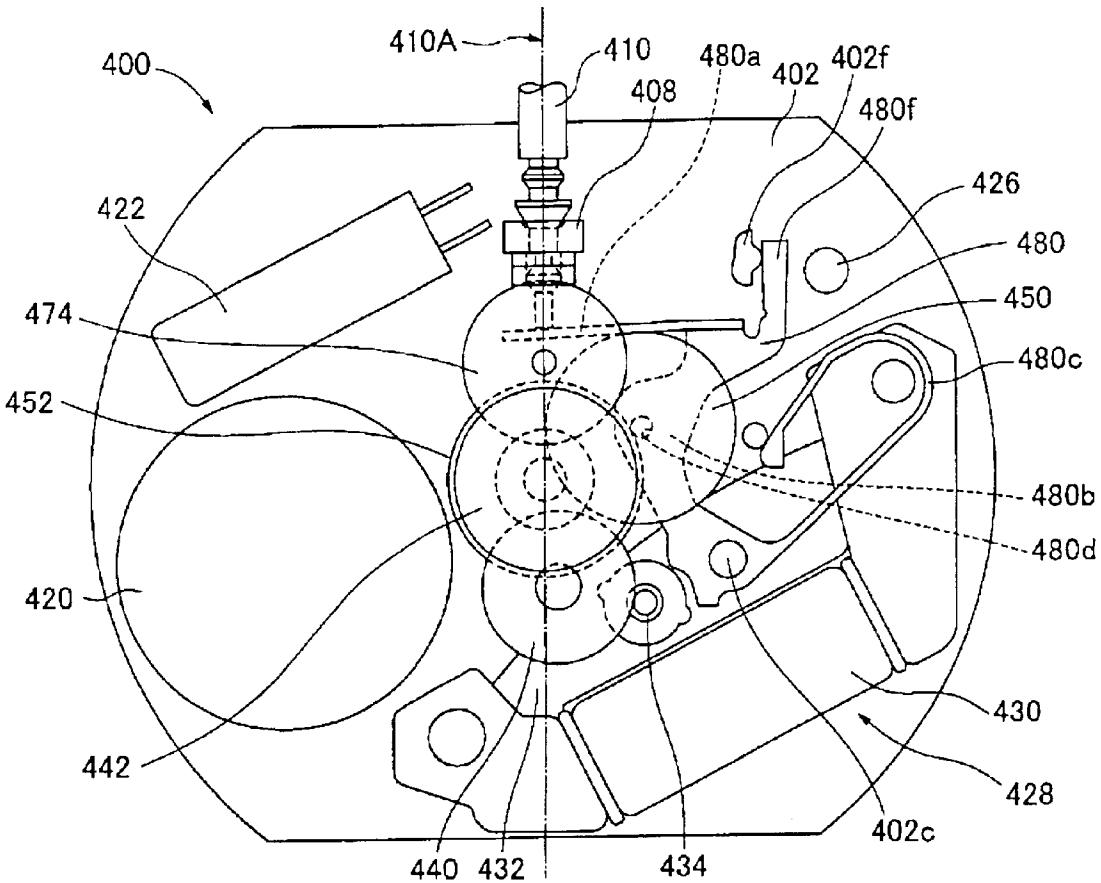
FIG. 10 PRIOR ART
FIG. 10 is a plane view showing an outline shape of a movement viewed from a surface side when a winding stem is disposed at 0 stage according to a conventional timepiece (In FIG. 10, illustration of a portion of parts is omitted)
Figure 11:
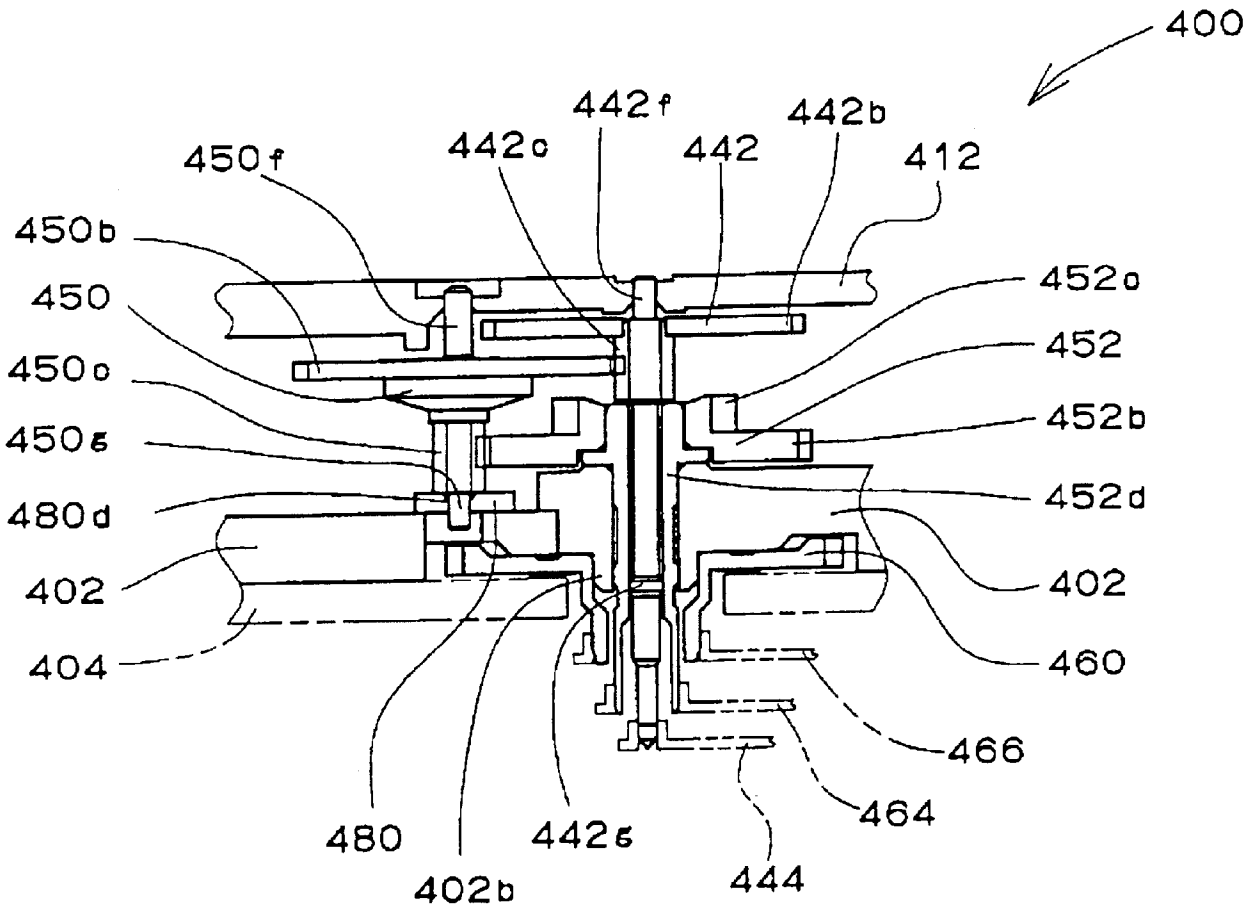
FIG. 11 PRIOR ART
FIG. 11 is an outline of partially sectional view showing a center wheel & pinion and a third wheel & pinion when the winding stem is disposed at 0 stage according to the conventional timepiece.
Figure 12:
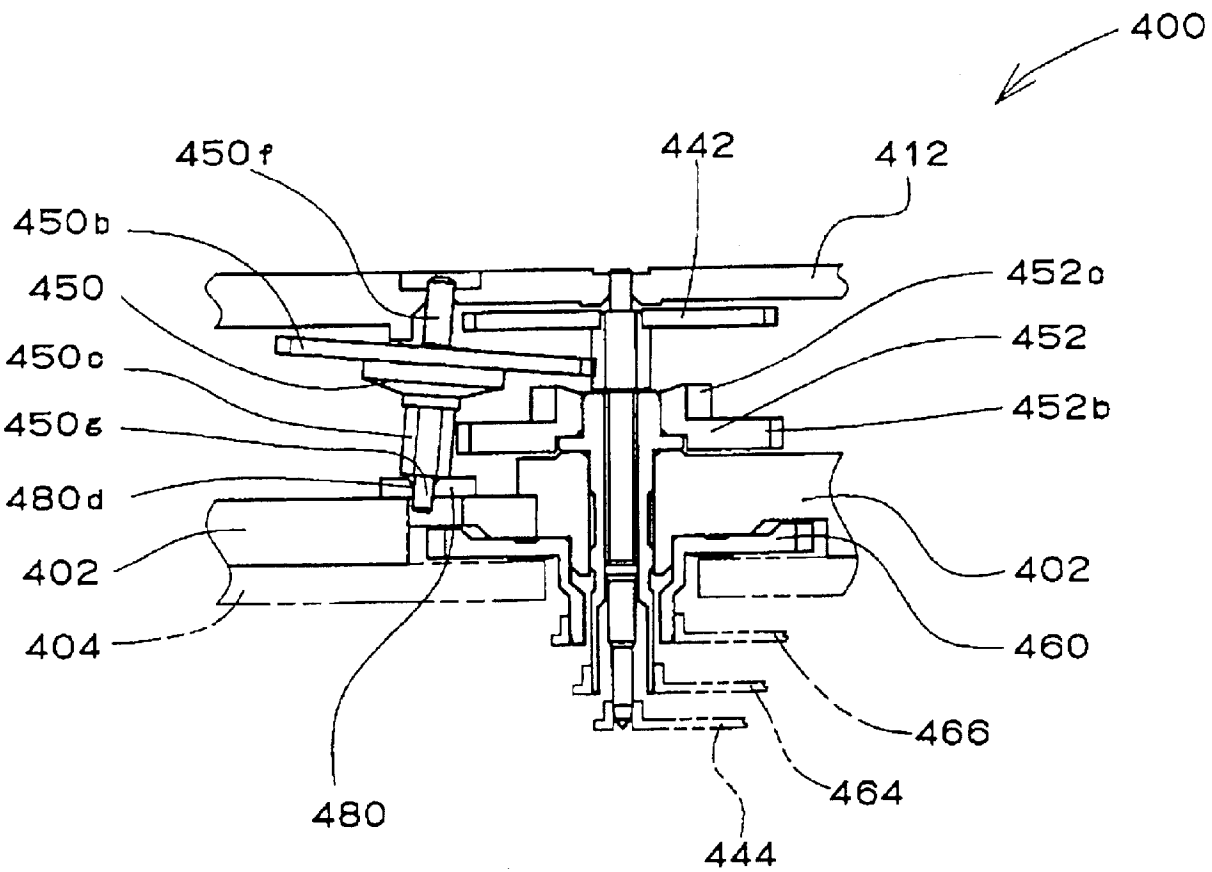
FIG. 12 PRIOR ART
FIG. 12 is an outline of partially sectional view showing the center wheel & pinion and the third wheel & pinion when the winding stem is disposed at 1 stage according to the conventional timepiece.

In reference to FIG. 5, it is preferable that a guide portion difference (DH−DB) which is a difference between an inner diameter dimension DH of the bush integrating hole 180*h* of the reset lever 180 and an outer diameter dimension DB of the guide portion 182*c* of the third bush 182, is constituted to be larger than a bearing portion diameter difference (DC−DJ) which is a difference between an inner diameter dimension DC of the center hole 182*h* of the third bush 182 and an outer diameter dimension DJ of the third lower shaft portion 150*g* of the third wheel & pinion 150. For example, it is preferable to constitute such that the inner diameter dimension DH of the bush integrating hole 180*h* of the reset lever 180 is 0.58 mm, the outer diameter dimension DB of the guide portion 182*c* of the third bush 182 is 0.55 mm and the guide portion diameter difference (DH−DB) is 0.03 mm. Further, it is preferable to constitute such that the inner diameter dimension DC of the center hole 182*h* of the third bush 182 is 0.219 mm, the outer diameter dimension DJ of the third lower shaft portion 150*g* of the third wheel & pinion 150 is 0.205 mm and the bearing portion diameter difference (DC−DJ) is 0.014 mm. For example, it is preferable that a dimension TB between a lower face of the flange portion 182*b* of the third bush 182 and an upper face of the fixed frame 184 is 0.26 mm and a thickness of the reset lever 180 is 0.2 mm. Therefore, between a lower face of the reset lever 180 and the upper face of the fixed frame, for example, an axial line direction clearance TS of 0.06 mm is provided.

By the constitution, when the winding stem 110 is pulled to 1 stage and the hands are set, the third bush 182 can be inclined to the reset lever 180 along with the third wheel & pinion 150. Therefore, under the state, there can be eliminated a concern of bending the third lower bearing portion 150*g* by the reset lever 180, further, there can be eliminated a concern of impairing the third lower bearing portion 150*g* by the reset lever 180.

It is preferable that the guide portion diameter difference (DH−DB) is constituted to fall in a range of 0.01 mm through 0.1 mm and the bearing portion diameter difference (DC−DJ) is constituted to fall in a range of 0.002 mm through 0.03 mm. It is further preferable that the guide portion diameter difference (DH−DB) is constituted to fall in a range of 0.02 mm through 0.04 mm and the bearing portion diameter difference (DC−DJ) is constituted to fall in a range of 0.004 mm through 0.01 mm. Further, it is preferable that the axial line direction clearance TS between the lower face of the reset lever 180 and the upper face of the fixed frame 184 is constituted to fall in a range of 0.02 mm through 0.1 mm. In any of the constitutions, it is preferable that the guide portion diameter difference (DH−DB) is constituted to be larger than the bearing portion diameter difference (DC−DJ). It is further preferable that the axial line direction clearance TS between the lower face of the reset lever 180 and the upper face of the fixed frame 184 is constituted to fall in a range of 0.05 mm through 0.07 mm.

Further, it is preferable that the axial line direction clearance TS between the lower face of the reset lever 180 and the upper face of the fixed frame 184, is constituted to be larger than the guide portion diameter difference (DH−DB) when the dimension TB between the lower face of the flange portion 182*b* of the third bush 182 and the upper face of the fixed frame 184, is equal to or smaller than the inner diameter dimension DH of the bush integrating hole 180*h* of the reset lever 180.

By the constitution, when the winding stem is pulled to 1 stage and the hands are set, it can be ensured to incline the third bush 182 and therefore, there can firmly be eliminated the concern of bending the lower bearing portion of the transmission wheel by the reset lever 180 and there can firmly be eliminated the concern of impairing the third lower bearing portion 150*g* by the reset lever.

It is preferable that an outer diameter dimension DF of the flange portion 182*b* of the third bush 182 is 1.0 mm and a thickness TF of the flange portion 182*b* is 0.15 mm. It is preferable that the outer diameter dimension DF of the flange portion 182*b* of the third bush 182 falls in a range of 0.75 mm through 2.0 mm. It is preferable that the thickness TF of the flange portion 182*b* of the third bush 182 falls in a range of 0.1 mm through 0.3 mm.

It is preferable that an outer diameter dimension DK of the fixed frame 184 is 1.0 mm and a thickness TK of the fixed frame 184 is 0.2 mm. It is preferable that the outer diameter dimension DK of the fixed frame 184 falls in a range of 0.75 mm through 2.0 mm. It is preferable the thickness TK of the fixed frame 184 falls in a range of 0.1 mm through 0.5 mm. In any of the constitutions, it is preferable that the outer diameter dimension DF of the flange portion 182*b* of the third bush 182 is constituted to be equal to the outer diameter dimension DK of the fixed frame 184.

In reference to FIG. 1 through FIG. 5, on "surface side" of the movement 100, the third bush 182 is arranged at the area (first area) on the left side of the central axis line 110A of the winding stem 110. A front end portion of the spring portion 180*c* of the reset lever 180 is arranged to be brought into contact with a spring contact portion 166*f* of the battery plus terminal 166. The reset lever 180 is brought into contact with the battery plus terminal 166 and therefore, the reset lever 180 conducts the anode of the battery 120 and the plus input portion Vdd of IC 118 via the plus pattern of the circuit block 116.

The main plate 102 is provided with a third bush positioning portion 102*f* for determining a position of the third bush 182 in a direction of a straight line connecting a rotational center of the center wheel & pinion 152 and a rotational center of the third wheel & pinion 150 when the winding stem 110 is disposed at 0 stage. When the winding stem 110 is disposed at 0 stage, it is constituted that by bringing an outer peripheral portion of the flange portion 182*b* of the third bush 182 and an outer peripheral portion of the fixed flame 184 into contact with the third bush positioning portion 102*f*, the position of the third bush 182 in the direction of the straight line connecting the rotational center of the center wheel & pinion 152 and the rotational center of the third wheel & pinion 150, can be determined. By the constitution, in an operational state in which the winding stem is disposed at 0 stage, a mesh state of the third pinion 150*c* and the center wheel 152*b* can be stabilized with high accuracy.

Further, when the winding stem 110 is disposed at 0 stage, the outer peripheral portion of the flange portion 182*b* of the third bush 182 and the outer peripheral portion of the fixed frame 184, are constituted to be guided by a third bush guide portion 102*d* provided on the main plate 102. Therefore, by providing the third bush guide portion 102*d* to the main plate 102, in the operational state in which the winding stem is disposed at 0 stage, the position of the third bush 182 in a direction orthogonal to the straight line connecting the rotational center of the center wheel & pinion 152 and the rotational center of the third wheel & pinion 150, can firmly be determined. It is preferable that the third bush guide portion 102*d* of the main plate 102 is fabricated in a shape of a long hole to be fitted to the outer peripheral portion of the flange portion 182*b* of the third bush 182 and the outer peripheral portion of the fixed frame 184 with clearances therebetween. By the constitution, in the operational state in which the winding stem is disposed at 0 stage, the mesh state of the third pinion 150*c* and the center wheel 152*b* can be stabilized with high accuracy.

As a modified example, it can also be constituted that when the winding stem 110 is disposed at 0 stage, the position of the third bush 182 can be determined by bringing the outer peripheral portion of the flange portion 182*b* of the third bush 182 into contact with the third bush positioning portion 102*f*. According to the constitution, when the winding stem 110 is disposed at 0 stage, the outer peripheral portion of the fixed frame 184 is not brought into contact with the third bush positioning portion 102*f*. Also according to the constitution, in the operational state in which the winding stem is disposed at 0 stage, the mesh state of the third pinion 150*c* and the center wheel 152*b* can be stabilized with high accuracy.

A reset pin 126 is attached to the main plate 102. The reset pin 126 is constituted to be conducted to a reset terminal of IC 118. On "surface side" of the movement 100, the reset pin 126 is disposed at the area (second area) on the right side of the center axis line 110A of the winding stem 110. The reset lever 180 is constituted to carry out reset operation when the reset lever 180 is brought into contact with the reset pin 126. On "surface side" of the movement 100, the rotational center of the reset lever 180 is arranged at the area (second area) on the right side of the central axis line 110A of the winding stem 110. On "surface side" of the movement 100, the reset pin 126 is arranged at the area (first area) on the left side of the central axis line 110A of the winding stem 110. When the winding stem 110 is disposed at 0 stage, the front end of the winding stem contact rigid portion 180*a* of the reset lever 180 is brought into contact with the side face of the winding stem 110. Under the state, the third pinion 150*c* is constituted to be brought in mesh with the center wheel 152*b*.

(2) A State in Which the Winding Stem is Disposed at 1 Stage (Time Correcting State)

In reference to FIG. 6 through FIG. 9, when the winding stem 110 is pulled from 0 stage to 1 stage, the position of the winding stem 110 at 1 stage is determined by positioning the winding stem positioning portion 166*b* provided at the battery plus terminal 166 between the winding stem positioning strip portion 110*d* of the winding stem 110 and the inner side wall portion 110*g* of the winding stem 110. When the winding stem 110 is pulled from 0 stage to 1 stage, the front end shaft portion 110*b* of the winding stem 110 is constituted to be fitted to the operating small diameter portion 108*c* of the clutch wheel 108. Therefore, when the winding stem 110 is disposed at 1 stage (when the analog electronic timepiece is set to the time correcting state) the clutch wheel 108 is constituted to rotate integrally with the winding stem 110 by rotating the winding stem 110.

Further, when the winding stem 110 is pulled from 0 stage to 1 stage, the winding stem contact rigid portion 180*a* of the reset lever 180 leaves the side face of the winding stem 110. Then, by the spring force of the spring portion 180*c* of the reset lever 180, the reset lever 180 is rotated in the clockwise direction (right turning direction) in FIG. 6 until-the reset operation portion 180*f* is brought into contact with the reset pin 126. When the reset operation portion 180*f* of the reset lever 180 is brought into contact with the reset pin 126, rotation of the reset lever 180 is finished. As the reset lever 180 is rotated in the clockwise direction (right turning direction) in FIG. 6, the third bush 182 is moved in a direction of being remote from the center wheel 152*b*. Therefore, in a state in which the reset operation portion 180*f* of the reset lever 180 is brought into contact with the reset pin 126, the third pinion 150*c* is not brought in mesh with the center wheel 152*b*. It is constituted that when the reset operation portion 180*f* of the reset lever 180 is brought into contact with the reset pin 126, the driving portion of IC 118 does not output the motor drive signal for driving the step motor 128.

When the winding stem 110 is rotated in the state in which the winding stem 110 is disposed at 1 stage, the clutch wheel 108 is rotated integrally with the winding stem 110. Then, by rotating the clutch wheel 108, the minute wheel 174 in mesh with the teeth portion 108*f* of the clutch wheel 108 is rotated. Then, by rotating the minute wheel 174, the center wheel & pinion 152 and the hour wheel 160 are rotated. Even when the winding stem 110 is rotated in the state in which the winding stem 110 is disposed at 1 stage, the third wheel & pinion 150, the second wheel & pinion 142, the fifth wheel & pinion 140 and the rotor 134 are not rotated. By the constitution, when the winding stem 110 is pulled to 1 stage and the hands are reset, by rotating the winding stem 110 in a state in which the second hand 144 is stopped, the minute hand 164 and the hour hand 166 can be rotated.

(3) A State of Pushing the Winding Stem to 0 Stage

In reference to FIG. 1 through FIG. 5 again, when the winding stem 110 is pushed from 1 stage to 0 stage, the position of the winding stem 110 at 0 stage is determined by positioning the winding stem positioning portion 166*b* provided at the battery plus terminal 166 between the winding stem positioning strip portion 110*d* of the winding stem 110 and the outer side wall portion 110*f* of the winding stem 110. When the winding stem 110 is pushed from 1 stage to 0 stage, the front end shaft portion 110*b* of the winding stem 110 leaves the operating small diameter portion 108*c* of the clutch wheel 108.

Further, when the winding stem 110 is pushed from 1 stage to 0 stage, the winding stem contact rigid portion 180*a* of the reset lever 180 is brought into contact with the side face of the winding stem 110 and pushed thereto. Then, the reset lever 180 is rotated in the counterclockwise direction (left turning direction) in FIG. 1 until the outer peripheral portion of the flange portion 182*b* of the third bush 182 and the outer peripheral portion of the fixed frame 184 are brought into contact with the third bush positioning portion 102*f*. In the state in which the winding stem 110 is disposed at 0 stage, the reset operation portion 180*f* of the reset lever 180 leaves the reset pin 126. When the reset operation portion 180*f* of the reset lever 180 leaves the reset pin 126, the driving portion of IC 118 is constituted to output the motor drive signal for driving the step motor 128.

When the outer peripheral portion of the flange portion 182*b* of the third bush 182 and the outer peripheral portion of the fixed frame 184 are brought into contact with the third bush positioning portion 102*f*, rotation of the reset lever 180 is finished. As the reset lever 180 is rotated in the counterclockwise direction (left turning direction) in FIG. 1, the third bush 182 is moved in a direction of being proximate to the center wheel 152*b*. Therefore, in the state in which the outer peripheral portion of the flange portion 182*b* of the third bush 182 and the outer peripheral portion of the fixed frame 184 are brought into contact with the reset lever positioning portion 102*f*, the third pinion 150*c* is constituted to be brought in mesh with the center wheel 152*b*.

(4) Constitution Capable of Positioning a Winding Stem to 0 Stage, 1 Stage and 2 Stage In explaining of the embodiment of the analog electronic timepiece according to the invention described above, an explanation has been given of the analog electronic timepiece having the constitution in which time is displayed in the state in which the winding stem is disposed at 0 stage and in the state in which the winding stem is disposed at 1 stage, operation of the analog electronic timepiece is stopped and time is corrected.

Therefore, structure and operation of an analog electronic timepiece having a structure capable of disposing a winding stem to 0 stage, 1 stage and 2 stage (an analog electronic timepiece having a constitution in which in the state in which the winding stem is disposed at 0 stage, the analog electronic timepiece displays time, in the state in which the winding stem is disposed at 1 stage, the analog electronic timepiece displays time and day correction and/or date correction is carried out and in the state in which the winding stem is disposed at stage 2, operation of the analog electronic timepiece is stopped and time is corrected), can well be understood by replacing "time display state" by "state in which the winding stem is disposed at 0 stage and 1 stage" and replacing "time correcting state" by "a state in which the winding stem is disposed at 2 stage" in the above-described explanation with regard to the embodiment of the analog electronic timepiece of the invention.

According to the analog electronic timepiece of the invention, when the winding stem is pulled to 1 stage and the hands are set, even in a state in which the transmission wheel, that is, the third wheel & pinion is inclined, there is not a concern of bending the lower bearing portion of the transmission wheel, that is, the lower bearing portion of the third wheel & pinion by the reset lever, further, there is not also the concern of impairing the lower bearing portion of the third wheel & pinion.

Further, according to the analog electronic timepiece of the invention, in the operational state in which the winding stem is disposed at 0 stage, the mesh state of the transmission pinion, that is, the third pinion and the indicator gear, that is, the center wheel can be stabilized.

Further, according to the timepiece of the invention, the reset lever can efficiently be arranged to the movement and therefore, the movement can be downsized.

What is claimed is:

1. An electronic timepiece comprising:

a main plate constituting a board;

a train wheel rotated by operating a motor constituting a drive source, the train wheel includes a transmission wheel having a transmission gear and a transmission pinion and rotated by operating the motor and an indicator wheel having an indicator gear and an indicator pinion and rotated by rotating the transmission wheel;

a winding stem for correcting time;

a reset lever constituted to be brought into contact with an outer diameter portion of a shaft portion of the winding stem when the electronic timepiece is set to a time display state and not to be brought into contact with the winding stem when the electronic timepiece is set to a time correcting state and rotatably provided to the main plate and having a spring portion;

a reset pin constituted to reset the electronic timepiece when the reset lever is brought into contact with the reset pin;

a guide portion of a bush having a center hole integrated to a bush integrating hole of the reset lever by providing a clearance in a diameter direction therebetween; and a lower shaft portion of the transmission wheel rotatably integrated to the center hole of the bush, wherein it is constituted that when the electronic timepiece is set to the time display state, a portion of the bush is brought into contact with a bush positioning portion of the main plate, the transmission pinion is brought in mesh with the indicator gear and the indicator wheel is rotated by operating the motor via rotation of the transmission wheel, and it is constituted that when the electronic timepiece is set to the time correcting state, the reset lever is rotated by a spring force of the spring portion, a portion of the reset lever is brought into contact with the reset pin and the transmission pinion is not brought in mesh with the indicator gear.

2. An electronic timepiece according to claim 1, wherein the bush further includes a flange portion and a front end shaft portion, a fixed frame is fitted to the front end shaft portion and an axis direction clearance (TS) is provided between a lower face of the reset lever and an upper face of the fixed frame.

3. An electronic timepiece according to claim 1, wherein it is constituted that a guide portion diameter difference (DH−DB) which is a difference between an inner diameter dimension (DH) of the bush integrating hole of the reset lever and an outer diameter dimension (DB) of the guide portion of the bush, is larger than a bearing portion diameter difference (DC−DJ) which is a difference between an inner diameter dimension (DC) of the center hole of the bush and an outer diameter dimension (DJ) of the lower shaft portion of the transmission wheel.

4. An electronic timepiece according to claim 3, wherein the axis line direction clearance (TS) is larger than the guide portion diameter difference (DH−DB) when a dimension (TB) between a lower face of the flange portion of the bush and the upper face of the fixed frame is equal to or smaller than the inner diameter dimension (DH) of the bush integrating hole of the reset lever.

* * * * *